US006631904B1

(12) United States Patent
Lennox et al.

(10) Patent No.: US 6,631,904 B1
(45) Date of Patent: Oct. 14, 2003

(54) GAME FOR TWO PEOPLE IN A RELATIONSHIP AND METHOD OF PLAY

(75) Inventors: Thomas Gordon Lennox, North Vancouver (CA); Robert Ian Gordon Brown, North Vancouver (CA)

(73) Assignee: R. D. Innovations, Inc., British Columbia (CA)

( * ) Notice: Subject to any disclaimer, the term of this patent is extended or adjusted under 35 U.S.C. 154(b) by 0 days.

(21) Appl. No.: 09/814,276

(22) Filed: Mar. 21, 2001

(51) Int. Cl.[7] ..... A63F 3/00
(52) U.S. Cl. ..... 273/236; 273/287
(58) Field of Search ..... 273/236, 287, 273/440, 429; 434/238

(56) References Cited

U.S. PATENT DOCUMENTS

| | | | | | |
|---|---|---|---|---|---|
| 2,414,614 | A | * | 1/1947 | Shurick | 434/238 |
| 2,883,765 | A | * | 4/1959 | Blaine | 232/4 R |
| 2,918,730 | A | * | 12/1959 | Schrade | 116/222 |
| 2,965,978 | A | * | 12/1960 | Olson | |
| 3,782,009 | A | * | 1/1974 | Darnell | 434/238 |
| 5,213,509 | A | | 5/1993 | Gunn | |
| 5,470,235 | A | * | 11/1995 | Papaleo | 434/238 |
| 5,573,404 | A | * | 11/1996 | Stawski, II | 434/238 |
| 5,573,405 | A | * | 11/1996 | Evans | 116/325 |
| 5,577,915 | A | * | 11/1996 | Feldman | 434/238 |
| 5,639,242 | A | * | 6/1997 | Wilson | 273/249 |
| 5,725,381 | A | * | 3/1998 | Kollath et al. | 434/238 |
| 5,775,700 | A | | 7/1998 | Hornia et al. | |
| 5,954,512 | A | * | 9/1999 | Fruge | 434/236 |
| 6,345,821 | B1 | * | 2/2002 | Labrot | 273/141 R |

* cited by examiner

*Primary Examiner*—Benjamin H. Layno
*Assistant Examiner*—Vishu K Mendiratta
(74) *Attorney, Agent, or Firm*—Kolisch Hartwell, P.C.

(57) ABSTRACT

A game to promote communication and understanding between couples. The game involves assigning points to a number of activities to be performed by one person, for example, the man, for the benefit of the second person, the woman. When the man performs an act such as letting the woman sleep in, taking the woman out to dinner, or giving the woman a gift, he is awarded the points assigned to that act. The accumulated points are tracked on a board. Once the points reach a certain level, the man is permitted to redeem the points for a reward such as a night out. The woman is permitted to block the awarding of points temporarily in the event of an extraordinary event such as the man forgetting the woman's birthday or not helping out with household chores.

29 Claims, 2 Drawing Sheets

| GREEN CARD | GOLD CARD | PLATINUM CARD |
|---|---|---|
| 10,000 Points | 100,000 Points | 1,000,000 Points |
| 1,000 Point Activities | 10,000 Point Activities | 100,000 Point Activities |
| .walking dog for one week.<br>.shoveling snow<br>.doing dishes for one week.<br>.buying flowers.<br>.taking kids to practices for one week.<br>.getting home on time.<br>.letting her sleep in.<br>.breakfast in bed.<br>.grocery shopping.<br>.wash her car.<br>. _____<br>. _____<br>. _____ | .take her out to dinner.<br>.go shopping together.<br>.clean up after a a party.<br>.agree to her holiday plans.<br>.see a "chick flick" with her, stay awake.<br>.recognize new hairdo.<br>.compliment a new outfit.<br>.outright acceptance of unknown dinner party.<br>.side with her in dispute with kids.<br>.overnight getaway.<br>. _____<br>. _____ | .joint bank account.<br>.inviting her parents for the weekend.<br>.a romantic weekend retreat.<br>.giving her that "gift she's always wanted".<br>.agreeing to her "weekend away with the girls".<br>. _____<br>. _____<br>. _____ |

FIG. 3

GAME FOR TWO PEOPLE IN A RELATIONSHIP AND METHOD OF PLAY

FIELD OF THE INVENTION

This invention relates generally to games and, more particularly, to a game to promote open communication and understanding between couples in a relationship with a reward component.

BACKGROUND OF THE INVENTION

Since the beginning of recorded relationships such as Adam and Eve, Samson and Delilah, Anthony and Cleopatra, couples have been involved in a constant struggle to understand the needs and desires of their partner. In many relationships, one partner is often prepared to perform a loving act for the other partner without thought to reciprocation. However, if one partner feels that their loving acts are not often being reciprocated, disharmony and resentment can develop in the relationship. To prevent this happening, it becomes important that both partners are kept aware of where they stand with respect to keeping their partner content. Thus, it can be desirable to track loving acts in which each partner takes into consideration the needs and wants of the other. If such tracking is done by way of a game that is enjoyable and simple to play, it becomes possible for a couple to maintain a mutually satisfying relationship based on both partners contributing in an equitable manner according to pre-defined ground rules.

SUMMARY OF THE INVENTION

Accordingly, there is a need for a game that allows the participants in a relationship to understand and track how they stand in respect of keeping their partner content and satisfied.

The present invention provides a method of playing a game to promote communication between first and second persons in a relationship comprising the steps of:

assigning points to a plurality of pre-defined activities to be performed by the first person for the benefit of the second person;

awarding the points assigned to a particular pre-defined activity to the first person upon performance of said activity by the first person;

tracking the accumulation of points by the first person;

blocking the awarding of points temporarily whenever the first person performs an undesirable activity; and redeeming points accumulated by the first person in exchange for a reward for the first person.

The game of the present invention allows both persons in a relationship to readily keep track of the points that have been accumulated and to have clearly defined the activities that will earn points. The game provides rewards based on accumulated points.

In accordance with another aspect of the invention, there is provided, a method of playing a game to promote communication between first and second persons in a relationship comprising the steps of:

assigning points to a plurality of pre-defined activities to be performed by the first person for the benefit of the second person at least two reward levels, each reward level being associated with a set number of points that must be accumulated before the points are redeemable for the reward;

awarding the points assigned to a particular pre-defined activity to the first person upon performance of said activity by the first person;

tracking the accumulation of points by the first person;

blocking the awarding of points temporarily whenever the first person performs an undesirable activity, wherein said blocking ends after a set period and said set period is different for each of the at least two reward levels; and redeeming points accumulated by the first person in exchange for a reward for the first person.

BRIEF DESCRIPTION OF THE DRAWINGS

Aspects of the present invention are illustrated, merely by way of example, in the accompanying drawings in which:

FIG. 3 is a view of a game chart setting out reward levels and activities to be performed to accumulate points within each reward level.

DESCRIPTION OF THE PREFERRED EMBODIMENTS

Figure 1:
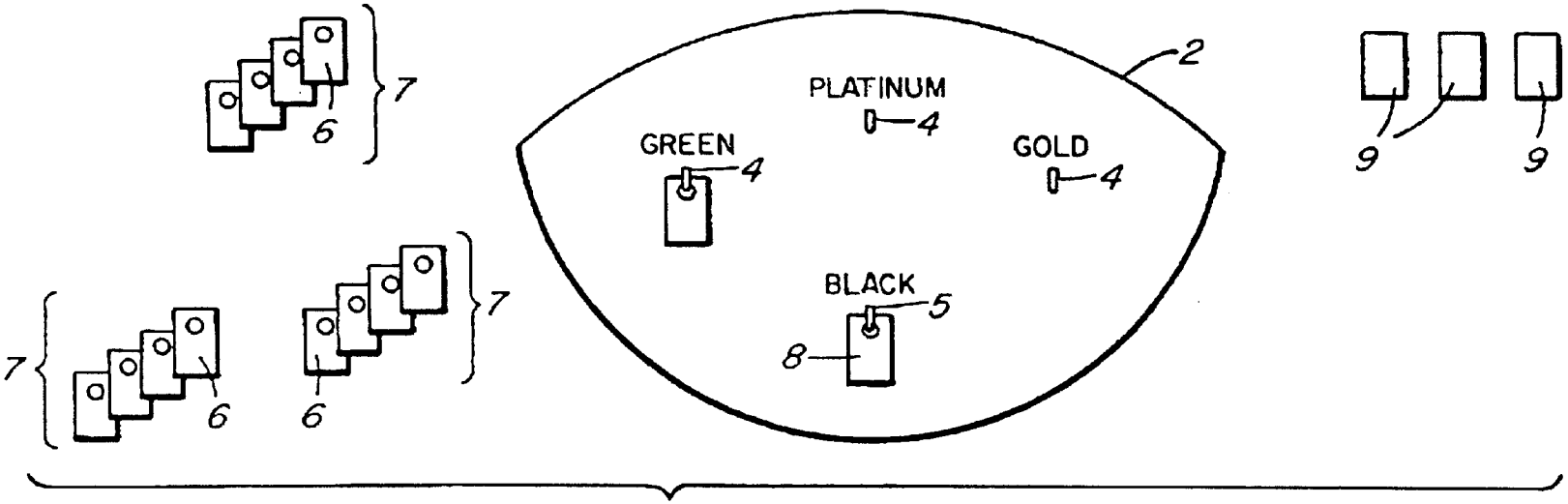
FIG. 1 is a front plan view of the game board for use with the game of the present invention.
Figure 2:
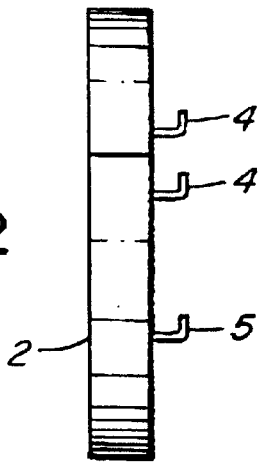
FIG. 2 is a side view of the game board.

Referring to FIG. 1, there is shown a preferred game board 2 for use with a preferred embodiment of the game of the present invention. The game board comprises a generally flat surface that is provided with a series of hooks 4,5 to receive tags 6 to allow the players of the game to keep track of the points being accumulated by a first player. In the illustrated embodiment, there are four hooks on the board. The upper three hooks are labeled with the words "GREEN", "GOLD" and "PLATINUM" which represent the colours assigned to the reward levels of the game. Tags 6 are arranged in sets 7 of identical colours that correspond to the colours of the reward levels. The lowermost hook 5 is provided to hang a tag 8, which is preferably black, that can be used by a second player to temporarily block the accumulation of points by the first player in the event that the first player engages in a proscribed activity. Hook 5 is a convenient location to display the black tag 8 to act as a visual reminder to the first player that the second player can prevent the accumulation of points.

The game is intended to be played primarily by couples in which a man comprises the first player who is accumulating points and a women comprises the second player. It will be apparent that other player arrangements are possible. Prior to the game commencing, both players familiarize themselves with the rules of the game. The woman as the second player preferably reads and signs an agreement setting out that she agrees to the rules of the game and will not cheat, change the rules or interfere with the first player's (man's) ability to receive any rewards earned by accumulation of sufficient reward points. For example, the language of the agreement can read as follows:

I, __, being of sound mind and body, do declare that I have read and understood the "Rules of the Game", and agree to abide by said "Rules". In return, I will be the sole recipient of all acts and deeds bestowed on me by my partner. I will not "cheat", nor attempt to "change the Rules", and will not interfere with my partner's right to his earned reward.

In the particular case where the first player is a man and the second player is a woman, the players decided before play begins as to the points to be assigned to a plurality of pre-defined activities to be performed by the man for the benefit of the woman. The game comes with a chart that provides examples of such activities with points to be awarded upon performance of the activity. The activities are preferably divided into at least two different groups or reward levels. In the preferred embodiment of the game, there are three reward levels distinguished by the colours "GREEN", "GOLD" AND "PLATINUM". Each reward level is represented by a corresponding colour card 9. Each reward level is also associated with a minimum number of points that must be accumulated before the points are redeemable for the reward associated with the particular reward level. The chart sets out the reward levels, the pre-defined activities that must be performed to accumulate points for each reward level, and the points associated with each activity.

FIG. 3 is an example of the game chart. The reward levels are arranged in columns. Blank spaces are left in each so that the players may insert their own activities. At the GREEN reward level, the man must accumulate 10,000 points to earn the associated reward. Activities at the GREEN reward level that earn 1000 points upon completion include such acts as walking the dog for one week, shovelling snow, doing the dishes for a week, buying flowers, taking the children to sports practices for one week, getting home on time, letting the woman sleep in, preparing and serving breakfast in bed, doing the grocery shopping and washing the woman's car. Similarly, activities at the GOLD reward level are worth 10,000 points on completion and activities at the PLATINUM reward level are worth 100,000 points on completion. The man must earn a total of 100,000 points to earn the reward associated with the GOLD reward level by performing activities such as taking the woman out to dinner, going shopping with the woman, cleaning up after a party, agreeing to the woman's holiday plans, seeing a "chick flick" with the woman and staying awake, recognizing a new hairdo, complimenting a new outfit, outright acceptance of unknown dinner party, siding with the woman in a dispute with the kids and participating in an overnight getaway with the woman. The man must earn a total of 1,000,000 points to earn the reward associated with the PLATINUM reward level by performing activities such as opening a joint bank account, inviting the woman's parents for the weekend, organizing a romantic weekend retreat, giving the woman the "gift she's always wanted", and agreeing to the woman's "weekend away with the girls".

The activities that the first player performs for the benefit of the second player in order to accumulate points that accrue to the benefit of the first player will necessarily be different depending on such factors as the sex, age and financial circumstances of the players.

Preferably, the points award for each activity and the total number of accumulated points to complete a reward level are arranged such that ten activities must be completed by the first player to earn a reward. Other arrangements are possible.

Each time an activity is completed by the first player at a particular reward level, a coloured tag 6 corresponding to the colour of the reward level is suspended from the hook 4 associated with the reward level. In this manner, the accumulated points of the first player can be easily tracked by inspection of game board 2.

Once the first player has accumulated the points necessary to complete a reward level, they receive a card 9 according to the colour of the reward level completed. They can then surrender the card to receive the reward associated with that particular reward level. It will be appreciated that as the point total awarded for completion of an activity increases, the complexity and difficulty of the activity increases. Similarly, the reward associated with a particular reward level increases as the points necessary to receive the reward increase. For example, the reward associated with accumulating 10,000 points at the GREEN reward level is a night out for the first player. The reward at the GOLD level is a weekend away, and the reward at the PLATINUM level is one week away.

Instead of surrendering the points for a reward, the first player also has the option of carrying forward the accumulated points toward the next reward level. For example, a first player who has accumulated 10,000 points and received a GREEN card 9 can roll these points over into the GOLD reward level. The 10,000 points are equivalent to completion of a single activity at the GOLD level, and to record the points, the first player surrenders their GREEN card 9 for a GOLD tag 6 which is suspended from the hook 4 associated with points accumulated at the GOLD reward level.

The first player is allowed to surrender their points for a reward once the points necessary for a particular reward level have been accumulated. Once the points are redeemed by the first player, the game can begin again. The first player is not allowed to begin playing again to accumulate points until after a reward is used to prevent stockpiling of rewards.

During game play, it is possible for the second player to temporarily block the awarding of points in the event that the first player performs an undesirable or proscribed activity. For example, in the case, where the first player is a man and the second player is a woman, undesirable activities that would warrant blocking the awarding of points includes such activities as:

1) the man forgetting the woman's birthday or anniversary
2) the man forgetting the children's birthday
3) the man mentioning an ex-girlfriend's name in a favourable way
4) the man failing to support the woman in child-related or personal matters
5) the man making negative comments or telling an insensitive story in the presence of others
6) the man failing to provide 24 hours notice of an event such as a meeting, trip or dinner engagement.

Other mutually agreed upon acts can also qualify as undesirable activities.

If an undesirable activity occurs, the second player is entitled to remove the black tag 8 from hook 5 on the game board and place it upon the hook where the first player is currently accumulating points to clearly indicate that the hook is blocked from recording points. Once the black tag is played, the first player is prevented from accumulating points for a temporary period. The temporary period ends after a finite time that is dependent on the reward level that has been blocked. The greater the number of maximum points for a reward level, the longer the time that awarding of points is blocked. For example, at the GREEN reward level, black tag 8 blocks points for 5 days. At the GOLD and PLATINUM levels, points are blocked for 10 and 15 days, respectively. Alternatively, it is possible for the first player to remove the black tag by performing an activity from the particular reward level without receiving credit for the assigned points. For example, if the first player is accumulating points at the GOLD reward level when they are blocked by a black tag, the first player can either wait 10 days before they can accumulate points or they can perform an activity associated with the GOLD reward level within 10 days to remove the black tag earlier. The first player does not receive credit for the points associated with the activity performed to remove the black tag. The black tag is returned to hook 5 to signal that blocking of awarding of points is over.

Although the present invention has been described in some detail by way of example for purposes of clarity and understanding, it will be apparent that certain changes and modifications may be practised within the scope of the appended claims.

We claim:

1. A method of playing a game to promote communication between first and second persons in a relationship comprising the steps of:

assigning points to a plurality of pre-defined activities to be performed by the first person for the benefit of the second person;

awarding the points assigned to a particular pre-defined activity to the first person upon performance of said activity by the first person;

tracking the accumulation of points by the first person;

blocking the awarding of points for a predetermined period whenever the first person performs an undesirable activity, wherein points cannot be awarded for any of the pre-defined activities during the predetermined period; and redeeming points accumulated by the first person in exchange for a reward for the first person.

2. A method as claimed in claim 1 in which there are at least two reward levels, each reward level being associated with a set number of points that must be accumulated before the points are redeemable for the reward.

3. A method as claimed in claim 2 including the step of providing the first person with the option of redeeming the set number of points accumulated at a particular reward level in exchange for the associated reward or carrying forward the points accumulated toward the next reward level.

4. A method as claimed in claim 2 in which the pre-defined activities are divided into categories for accumulating points toward a particular reward level, the activities in each category being assigned the same point value.

5. The method of claim 2 in which the step of tracking the accumulation of points is performed on a game board.

6. The method of claim 5 in which the step of tracking the accumulation of points involves hanging a tag from a hook on the game board, the game board being provided with one hook for each reward level.

7. The method of claim 6 in which each of the at least two reward levels is associated with a different colour of tag.

8. The method of claim 6 in which the step of blocking the awarding of points temporarily involves the second person hanging a unique tag on the hook where the first person is accumulating points to indicate to the first person that points cannot be awarded.

9. The method of claim 8 in which the unique tag is black.

10. The method of claim 8 in which the game board includes a hook to support the unique tag when not in use.

11. The method of claim 5 in which the step of tracking the accumulation of points involves placing a tag at a location on the game board, the game board being provided with a location for each reward level.

12. The method of claim 11 in which the step of blocking the awarding of points temporarily involves the second person placing a unique tag at the location where the first person is accumulating points to indicate to the first person that points cannot be awarded.

13. The method of claim 1 in which the step of blocking the awarding of points temporarily ends when the first person performs one of the pre-defined activities without accumulating the points associated with said activity.

14. The method of claim 2 in which the step of blocking the awarding of points temporarily ends after a set period.

15. The method of claim 14 in which the set period is different for each of the at least two reward levels.

16. The method of claim 15 in which the set period increases with the number of points needed to reach a reward level.

17. The method of claim 2 wherein the game includes:

a rule guide, a chart setting out each of the at least two reward levels, the pre-defined activities for each reward level, and the points associated with each activity, and an agreement to be signed by the second person accepting the terms of the game.

18. A method of playing a game to promote communication between first and second persons in a relationship comprising the steps of:

assigning points to a plurality of pre-defined activities to be performed by the first person for the benefit of the second person at least two reward levels, each reward level being associated with a set number of points that must be accumulated before the points are redeemable for the reward;

awarding the points assigned to a particular pre-defined activity to the first person upon performance of said activity by the first person;

tracking the accumulation of points by the first person;

blocking the awarding of points temporarily whenever the first person performs an undesirable activity, wherein said blocking ends after a set period and said set period is different for each of the at least two reward levels; and redeeming points accumulated by the first person in exchange for a reward for the first person.

19. A method as claimed in claim 18 including the step of providing the first person with the option of redeeming the set number of points accumulated at a particular reward level in exchange for the associated reward or carrying forward the points accumulated toward the next reward level.

20. A method as claimed in claim 18 in which the pre-defined activities are divided into categories for accumulating points toward a particular reward level, the activities in each category being assigned the same point value.

21. The method of claim 18 in which the step of tracking the accumulation of points is performed on a game board.

22. The method of claim 21 in which the step of tracking the accumulation of points involves placing a tag at a location on the game board, the game board being provided with a location for each reward level.

23. The method of claim 22 in which the step of blocking the awarding of points temporarily involves the second person placing a unique tag at the location where the first person is accumulating points to indicate to the first person that points cannot be awarded.

24. The method of claim 22 in which each of the at least two reward levels is associated with a different colour of tag.

25. The method of claim 23 in which the unique tag is black.

26. The method of claim 23 in which the game board includes a projection to support the unique tag when not in use.

27. The method of claim 18 in which the step of blocking the awarding of points temporarily ends when the first person performs one of the pre-defined activities without accumulating the points associated with said activity.

28. The method of claim 18 in which the set period increases with the number of points needed to reach a reward level.

29. The method of claim 18 wherein the game includes:

a rule guide, a chart setting out each of the at least two reward levels, the pre-defined activities for each reward level, and the points associated with each activity, and an agreement to be signed by the second person accepting the terms of the game.

* * * * *